US005331957A

United States Patent [19]

Liu

[11] Patent Number: 5,331,957

[45] Date of Patent: Jul. 26, 1994

[54] RESPIRATOR FOR ONLY FILTERING AIR INHALED

[76] Inventor: Chin-Chia Liu, 4 Fl., No. 23, Alley 8, Lane 57, Yu-Ch'i St., Yung-Ho City, Taipei Hsien, Taiwan

[21] Appl. No.: 14,355

[22] Filed: Feb. 5, 1993

[51] Int. Cl.[5] ..... A62B 7/10; A62B 18/08; A62B 23/02; A62B 19/00

[52] U.S. Cl. ..... 128/206.15; 128/206.17

[58] Field of Search ..... 128/206.15, 206.12, 128/206.28, 205.29, 206.21, 207.11, 206.26, 206.24, 201.28, 204.26, 205.24, 203.11, 201.11, 206.17; 137/852, 855

[56] References Cited

U.S. PATENT DOCUMENTS

| | | | |
|---|---|---|---|
| 216,171 | 6/1879 | Foster | 128/206.15 |
| 2,070,241 | 2/1937 | Schwartz | 128/206.17 |
| 2,216,619 | 10/1940 | Lehmberg | 128/206.15 |
| 2,894,508 | 7/1959 | Miles et al. | 128/206.17 |
| 3,521,630 | 7/1970 | Westberg et al. | 128/206.25 |
| 4,981,138 | 1/1991 | Courtney | 128/206.15 |

*Primary Examiner*—Kimberly L. Asher
*Attorney, Agent, or Firm*—W. Wayne Liauh

[57] ABSTRACT

A respirator for only filtering air inhaled, which comprises a nose-cover portion and mouth-cover portion for covering a person's nose and mouth respectively; both sides of the two portions have lugs to be fastened together using a strap; each of the two portions has an exhausting hole without filter; the exhausting hole can be closed with a valve flap, and the exhausting hole can exhaust air only. The nose-cover portion includes an exhausting hole, which is mounted around with two layers of plastic nets; the upper plastic net can be lifted up to insert a gauze or a similar filter, which can be clamped between the two layers so as to provide the function of filtering air inhaled only.

4 Claims, 4 Drawing Sheets

RESPIRATOR FOR ONLY FILTERING AIR INHALED

BACKGROUND OF THE INVENTION

Nature has skillfully given each of us a nose, which includes, among other things, nose hair and a secretion gland to kill all bacteria entered, and the ability to change a cold air inhaled into a warm air for protecting our breathing system. On comparison, our mouth has no such functions. It is the God's will that we should breathe through nose, but not the mouth; the mouth should be closed completely, and should only exhale air, if necessary.

However, the conventional respirator usually has one piece to cover one's nose and mouth. An individual often opens his (or her) mouth in sleep when snoring; therefore, such an action would violate the principle of protecting the breathing system with nose, and may develop a cold or tonsillitis as a consequence.

SUMMARY OF THE INVENTION

This invention relates to a respirator for only filtering air inhaled, which comprises a nose-cover portion and a mouth-cover portion, being assembled together by means of lugs thereof and a strap; each of the two portions has a check valve flap and an exhausting hole, through which the air exhaled can be exhausted quickly without filtering so as to minimize the muggy and smelly odor. Around the exhausting hole of the nose-cover portion, there are two layers of plastic nets (an upper and a lower layer) to clamp a filter, such as a gauze, for filtering the air inhaled only.

DETAILED DESCRIPTION OF THE INVENTION

Figure 6:
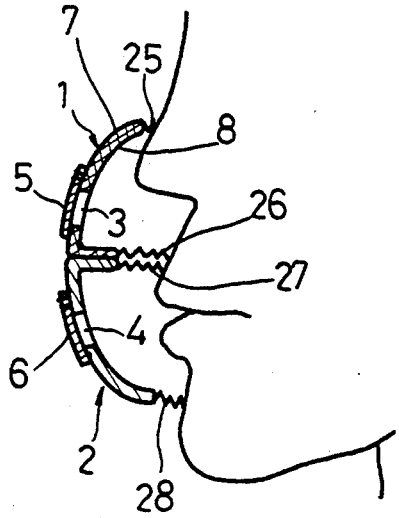
FIG. 6 illustrates the present invention being used by a user.
Figure 1:
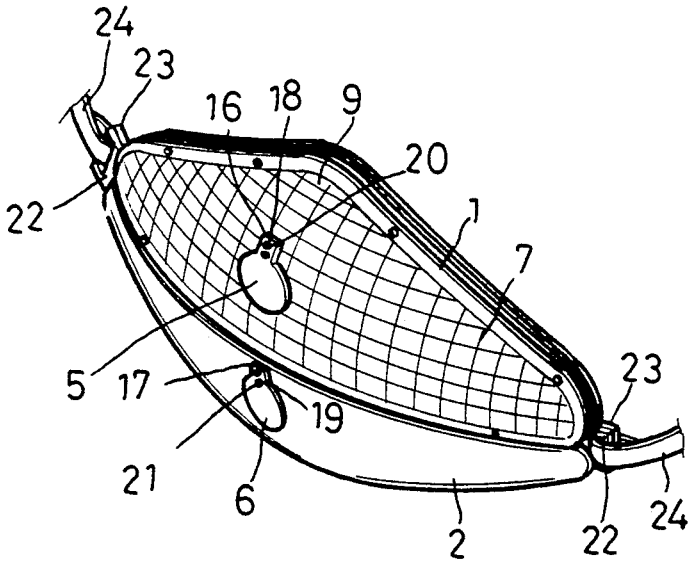
FIG. 1 is a perspective view of an embodiment according to the present invention.
Figure 2:
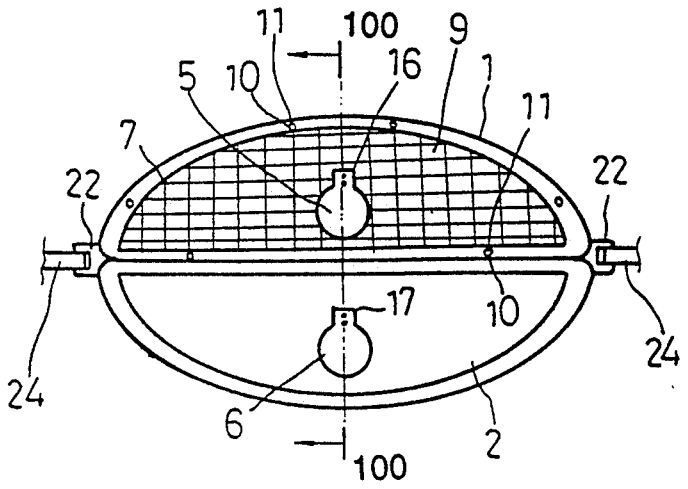
FIG. 2 is a front view of an embodiment of the present invention.
Figure 3:
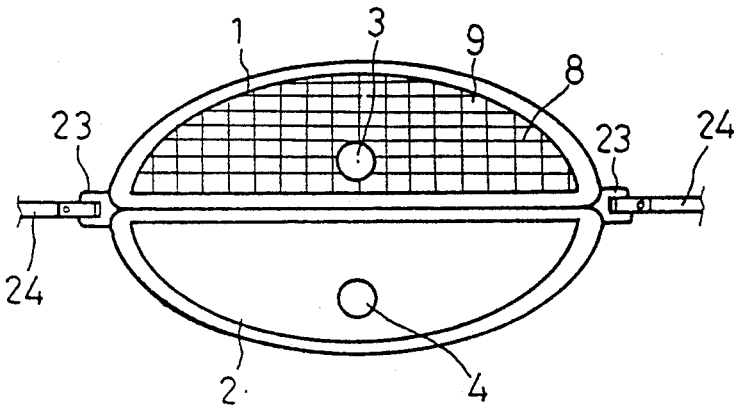
FIG. 3 is a rear view of an embodiment of the present invention.
Figure 4:
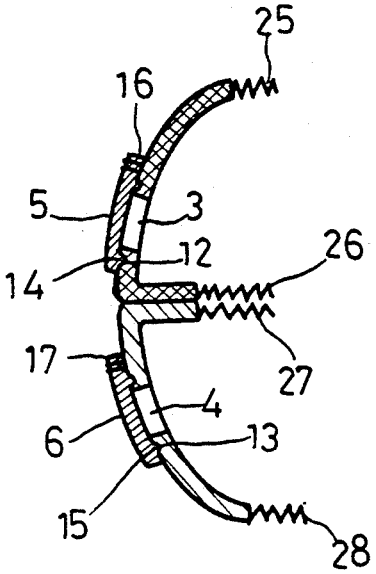
FIG. 4 is a sectional view taken only line A—A in FIG. 2.
Figure 5:
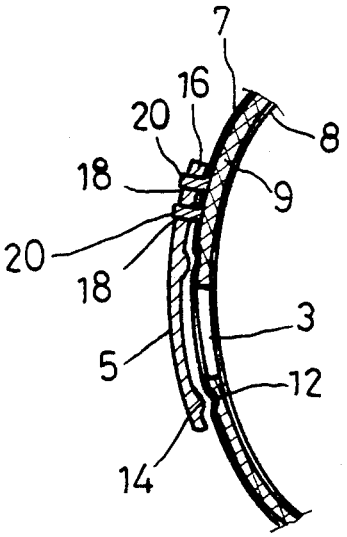
FIG. 5 is an enlarged section view of an exhausting hole and a valve flap in an embodiment of the present invention.
Figure 7:
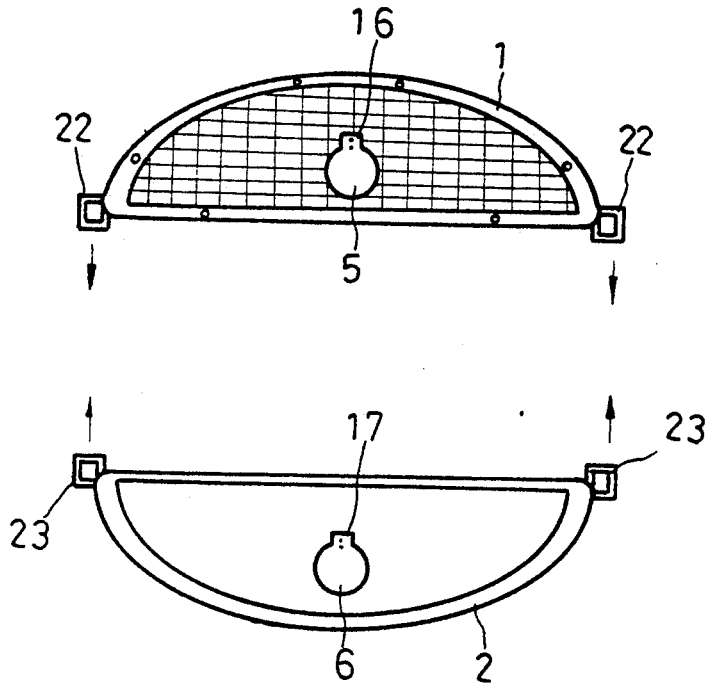
FIG. 7 illustrates the lugs on both sides of the two portions of the present invention.

Referring to FIG. 1, the respirator according to the present invention comprises two portions, i.e., a nose-cover portion 1 and a mouth-cover portion 2, both of which are in close contact with a user's face skin. The nose-cover portion 1 and the mouth-cover portion 2 include exhausting holes 3 and 4, and valve flaps 5 and 6 respectively. Each of the aforesaid valve flaps can only exhale air in one way, and is unable to inhale. The mouth-cover portion 2 is made of an air-tight plastic material. The nose-cover portion 1 is made of two layers of plastic nets 7 and 8 around the exhausting hole 3; a piece of gauze 9 is clamped between the two plastic nets as a filter. The edge of the upper plastic net 7 is furnished with six small holes 10 to be mated with the corresponding six pegs 11 on the edge of the lower plastic net 8 so as to facilitate the gauze 9 between the two plastic nets to be replaced, if necessary. Since the mask according to the present invention is made of a plastic material, which is washable and sterilizable, it can be used for a long time as soon as the gauze is replaced continuously. A fresh air can be inhaled into the nose after being filtered through the gauze 9. The exhausting holes 3 and 4 are formed into round grooves 12 and 13 respectively (or oval-shaped grooves), which are to be mated with two round flanges 14 and 15 (or oval-shaped flanges) respectively. The top side of the valve flaps 5 and 6 are furnished with two elastic tongue-shaped pieces 16 and 17 with two holes 18 and 19 respectively. The two holes 18 and 19 are to be mounted on two pegs 20 and 21, respectively, so as to have the two flaps 5 and 6 fastened to the exhausting holes 3 and 4, respectively. Both sides of the nose-cover portion 1 and mouth-cover portion 2 have two lugs 22 and 23 respectively, and every two corresponding lugs can be superimposed and fastened together with a strap 24 so as to form into a complete respirator. When the strap 24 is mounted on a user's ears, the respirator will cover the nose and the mouth closely and elastically as a result of the corrugated plastic portions 25, 26, 27 and 28 around the edge of the respirator. In fact, the mouth-cover portion 2 of the respirator may be used separately.

In actual use, the valve flaps 5 and 6 can be opened automatically when the user exhales, and then they will be closed automatically when the user exhales; in other words, the inhaling air will enter the mask through the filter gauze 9 completely. Since the respirator according to the present invention will cover a user's mouth completely, an exhaling function can quickly be done, but the normal breathing action can be performed through user's nose completely. The present invention is deemed able to provide the following functions:

a. To prevent a person from catching a cold.

b. To hold the mouth water (saliva) in the mouth to keep the larynx moistened so as to prevent a person from getting tonsillitis.

c. To conform to the requirement of practising the so-called "Chiao-Yang Kung-Fu", by which a person has to exhale through mouth, and to inhale through nose.

I claim:

1. A respirator for only filtering air inhaled comprising a nose-cover portion and a mouth-cover portion, each of said portions having a lug at each side, a strap, said strap passing through each of said lugs to fasten said portions together to form a single mask; both said nose-cover portion and said mouth-cover portion having identical exhausting holes, and each said exhausting hole having a valve flap which serves as a check valve to prevent inhalation through the exhausting hole; said mouth-cover portion being made of an airtight material; said nose-cover portion including an upper and lower layer of plastic net; said upper layer of plastic net being liftable to facilitate the clamping of a filter, such as gauze, between said two layers so as to filter air inhaled through the nose.

2. A respirator for only filtering air inhaled as claimed in claim 1, wherein said exhausting holes and said valve flaps are each furnished with an oval-shaped groove and an oval-shaped flange respectively, to engage each other in an airtight manner.

3. A respirator for only filtering air inhaled as claimed in claim 1, wherein said exhausting holes and said valve flaps are each furnished with a round groove and a round flange respectively, to engage each other in an airtight manner.

4. A respirator for only filtering air inhaled as claimed in claim 1, wherein said mouth-cover portion includes a thin corrugated plastic edge portion to provide an airtight contact with a user's face.

* * * * *